US007758235B1

(12) United States Patent
Collette

(10) Patent No.: US 7,758,235 B1
(45) Date of Patent: Jul. 20, 2010

(54) RECYCLED ASPHALT PAVEMENT (RAP) PREPARATION SYSTEM

(76) Inventor: Jerry R. Collette, 1251 E. 279th St., Unit J, Euclid, OH (US) 44132

( * ) Notice: Subject to any disclaimer, the term of this patent is extended or adjusted under 35 U.S.C. 154(b) by 1263 days.

(21) Appl. No.: 11/214,750

(22) Filed: Aug. 31, 2005

Related U.S. Application Data

(60) Provisional application No. 60/612,782, filed on Sep. 27, 2004.

(51) Int. Cl.
*B28C 5/46* (2006.01)
*B28C 9/00* (2006.01)

(52) U.S. Cl. ..... 366/7; 366/23; 366/147; 432/139

(58) Field of Classification Search ..... 366/7, 366/14–15, 22–25, 50, 147, 149, 64–66; 165/109.1; 404/92, 115; 432/120–213
See application file for complete search history.

(56) References Cited

U.S. PATENT DOCUMENTS 4,338,869 A * 7/1982 Hoskinson ..... 110/346
4,540,287 A * 9/1985 Servas et al. ..... 366/7
5,312,246 A * 5/1994 Brock ..... 432/139
5,547,277 A * 8/1996 Caspelherr et al. ..... 366/146
5,692,831 A * 12/1997 Campbell ..... 366/325.2
6,267,497 B1 * 7/2001 Rhee ..... 366/186
7,160,021 B2 * 1/2007 Yamazaki et al. ..... 366/149
7,384,181 B1 * 6/2008 Collette ..... 366/7
7,566,162 B1 * 7/2009 Swanson ..... 366/7
2007/0268778 A1 * 11/2007 Velsor ..... 366/7

FOREIGN PATENT DOCUMENTS

GB 2115711 A * 9/1983

* cited by examiner

*Primary Examiner*—Charles E Cooley
(74) *Attorney, Agent, or Firm*—James Creighton Wray; Meera P. Narasimhan

(57) ABSTRACT

Thermal processing of recycled asphalt pavement (RAP), having up to approximately 8% or more moisture content, dries and preheats the material to enhance efficient recycling in a hot mix asphalt plant. A combustor and heat exchanger reheat circulating hot oil, which with hot gas, moves through a hollow auger and around the RAP counter to the flow of RAP. Moisture is forced outward from within the particles and is flashed away by the hot exhaust gas. A similar secondary heater heats the RAP to just below asphalt coking temperature before the hot dry RAP is added as an aggregate to the hot mix asphalt plant.

8 Claims, 13 Drawing Sheets

RECYCLED ASPHALT PAVEMENT (RAP) PREPARATION SYSTEM

This application claims the benefit of U.S. Provisional Application No. 60/612,782, filed Sep. 27, 2004, which is hereby incorporated by reference in its entirety.

BACKGROUND OF THE INVENTION

This invention relates to the thermal processing and restoration of used asphalt paving materials after they have been removed from road surfaces by milling, grinding or ripping. After the bituminous paving materials have been removed from the roadbed, they are hereafter referred to as recycled asphalt pavement ("RAP").

It is generally known that the majority of existing roadways, both concrete and bituminous asphalt, undergo constant repair and surface overlay with new hot mix asphalt to achieve and maintain safe and comfortable high speed riding surfaces.

In recent years, new equipment has been introduced to the road paving industry in the form of pavement milling or grinding machines. The science of preparing an old roadbed base for new resurfacing is now commonly referred to as milling. Both state and Federal Department of Transportation (DOT) agencies throughout the country have readily accepted the science of milling.

The milling of old road surfaces provides a number of advantages in preparing the old roadbed for resurfacing. Milling not only ensures a new, smooth and level base for the new hot mix overlay, but at the same time lowers the road bed height to maintain bridge deck clearances and curb and gutter depths. Grinding or milling is also beneficial in removing potholes, old cracks, joint seams, and ruts along with other surface damage that would quickly reappear in a new surface overlay if not repaired. With many of the state and Federal DOT agencies now requiring the milling of road surfaces before permitting new overlay, there is an increasing inventory of asphalt millings being generated. The piles of discarded asphalt millings are becoming problems for land use, aesthetics and the environment. Attempts at reuse have proven difficult.

Generally speaking, asphalt plants average 400 tons per hour to 600 tons per hour production ranges and 15% to 30% RAP can be injected into these plants. When attempting to inject cold wet RAP into hot mix plants, the existing processes rely almost entirely on super heated virgin aggregates (600° F. to 900° F.) to conductively transfer enough heat to the cold wet RAP for drying and heating all materials to a mixing temperature of 300° F. The sudden and violent steam expansion that is created when the super hot aggregate (600° F.-900° F.) encounters the cold wet RAP instantly overloads exhaust system airflow capacity.

If the RAP injection is being done in a "drum mixer" type asphalt plant where all injection of RAP is done inside of the aggregate dryer, the steam explosion restricts the dryer air flow and overloads the exhaust vacuum system forcing the operator to lower plant production rates to restore exhaust vacuum and air flow on the drum to maintain final mix temperature.

When RAP injection is attempted on "batch" type asphalt plants, the cold wet RAP is injected into the weigh hopper section of the batcher above the pug mill mixer and when the RAP instantly mixes with the hot aggregate in the weigh hopper, a violent steam explosion occurs blowing steam and dust into the air creating fugitive emissions and sometimes even damaging the hopper section from pressure surges.

Injecting RAP into batch plants can also be very restrictive in tonnage output so as to avoid damaging the plant. Generally, batch plants cannot accept more than 15% to 20% RAP recycling.

In either methods of recycling RAP, whether in a drum mixer or in a batch plant, the pre-drying and super heating of the virgin aggregates is the only method of heat transfer to the RAP. The RAP must be dried and then heated to the mix temperature via conduction only from the aggregate. The virgin aggregate must be super heated in order to load enough heat in the material to transfer the energy to the RAP but still retain enough heat to have all material exit at 300° F. By having to elevate aggregates to 700, 800 and 900° F., the rotary dryers that heat the sand and stone must be subjected to extreme temperatures and this is causing many premature failures. Dryers are manufactured to operate with continuous skin temperatures in the 500° F. range and less. When these drum shells are exposed to the higher temperatures required running RAP mixes, they will crack and fail as well as experience extreme and premature wear.

Therefore, the following negative aspects of current methods for processing RAP into hot mix asphalt in plants need to be addressed: (1) Dryers must heat virgin aggregates to excessively high temperatures to dry and heat RAP and can therefore inflict heat damage, premature wear, and failure to the process, (2) Plant productive capacity drops off dramatically when running RAP due to exhaust system and dryer burner overloads from RAP steam blockages within dryers, (3) Batch Plants are limited as to RAP injection capacity due to fugitive emissions problems and potential plant damage due to violent steam explosions, and (4) RAP injection percentages are limited by aggregate temperatures for conductive heating. Heating aggregates above 600° F. can cause aggregate to fracture and allow mix gradations to drift out of specifications.

Needs exist for new recycling methods and apparatus for the recycling of asphalt pavement millings.

SUMMARY OF THE INVENTION

Using the methods and apparatus of the present invention, asphalt pavement millings are recycled with economic benefit. Recycled asphalt pavement millings are a valuable source of aggregate, screenings, sand, fines and asphaltic bituminous binders (asphalt) that are reused to manufacture new hot mix asphalt pavement.

The liquid petroleum savings alone from recycling old pavement is significant. For every ton of millings that are recycled into new pavement, 12 gallons of liquid asphalt are saved and reused.

Liquid asphalt is by far the most significant cost ingredient in the mix. The new techniques of milling the old pavement produce a uniformly crushed and pre-sized material that is usually about ¾" or less in size.

When the crushed and sized millings are fed into the new process system, it is slowly and gradually heated by applying a controlled amount of indirect heat, at a precise temperature level, with extended exposure time.

Many of the conventional hot mix asphalt plants supplying new asphalt to our roads add small percentages of recycled milling to their virgin plant mix materials. As a general rule however, those plants can only use about 20% to 30% ratios of the recycled millings in the new hot mix asphalt without creating excess air pollution emissions such as hydrocarbon smoke, dust and petroleum fumes.

The amount of recycled millings used in conventional asphalt plants is limited by the plants' design ability to withstand higher virgin aggregate process temperatures, required to conduct sufficient heat to dry and heat the millings. Those extremely high temperatures can severely damage carbon steel dryer shells when exposed to temperatures of 600 to 900° F. for extended periods.

For example, recycling a 50% ratio of millings at 5% moisture content in a typical hot mix asphalt plant would require a virgin aggregate temperature of 904° F. to transfer sufficient BTU's of heat via conduction to achieve a final mix temperature 320° F. The radical and instantaneous explosion of steam generated by moisture in the recycled millings, when contacting the super heated virgin aggregate, can be quite violent and difficult to contain.

Recycled millings should be heated by convection and conduction only, since radiation temperatures from the burner flame envelope are generally much too high at 2,400° F. for the asphalt to absorb without burning, smoking, coking and becoming hard and brittle. It is accurate to state that recycling millings at more than 30% has not yet achieved the status of a clean, consistent and predictable science.

With new laws requiring the milling of road surfaces prior to paving, together with savings in natural resources of both aggregate and petroleum, it is apparent that there are immediate and on-going needs for the development and implementation of technology capable of recycling 100% of the millings.

It is further apparent that current technology using super heated virgin aggregate to dry and heat the millings to paving mix temperatures is limited to an aggregate temperature level of 600° F. or less and is therefore inherently limited to using millings ratios of 30% or less in new hot mix paving.

This new technology utilizes a unique indirect heating method with slow gradual and controlled temperature elevation to decrease moisture content and preheat RAP to a temperature level between about 70° F. and 300° F. prior to entry into a conventional drum mix or batch type hot mix asphalt plant. Using conductive and convective heat transfer methods to preheat and dry the RAP prevents high temperature thermal fracturing of the virgin aggregate and eliminates coking damage to the liquid asphalt.

The process is unique in that it utilizes a relatively low temperature conductive heating method (auger) to slowly pre-dry and heat the cold wet RAP to prepare it to achieve hot mix paving temperature of approximately 300° F. It also utilizes the heated exhaust gas from the primary hot fluid heat exchanger to also heat the RAP convectively and to evacuate any RAP moisture that results from the process. All of the moisture is then ducted to the plant exhaust system for evacuation to atmosphere. RAP moisture may also be stacked directly to atmosphere from a heated auger if desired.

It may also be desirable to process 100% virgin aggregate or any percentage thereof with the RAP material to pre-dry and pre-heat prior to dryer entry. In some cases, aggregate moisture content exceeds RAP moisture content having greater production increase potential than does the RAP.

The system of the present invention utilizes a hollow, fully jacketed heated auger to dry and heat the RAP by conduction. The present invention does not take the RAP and virgin aggregate to hot mix temperatures in the making of new hot mix material. The unit is specifically designed and oriented to slowly elevate the RAP and aggregate to a temperature either just below boiling point of water (212° F.) or just above the boiling point of water (212° F.) in order to dry the material and preheat it to whatever temperature is desired for injection into the final asphalt hot mix process. The pre-dried material is then fed into an existing hot mix asphalt plant that is built to receive a percentage of RAP and aggregate and utilize it as part of the hot mix asphalt production.

Large, hollow, slow-rotating, heated augers that utilize approximately 400° F. to 550° F. heat exchange fluid slowly transfer heat in an effective and non-violent conductive method of elevating RAP temperature. RAP and aggregate are reluctant to release internal moisture due to the existing asphalt coating on the rock surface and deep in the pores of the stone. The asphalt coating on the original hot mix material acts as an insulation preventing heat penetration into the core of the rock where the moisture must be removed before liquid asphalt can be re-applied to coat the stone. Applying quick high temperature convective heat to the surface of the RAP does not allow for sufficient dwell time at temperature to drive the heat to the center of the rock, as this is a dwell time versus particle size mass function.

Heating the RAP by conduction slowly and gradually greatly reduces the quick steam venting from the rock and limits "stripping activity" that can occur when the liquid asphalt is "boiled" off of the surface. The ultimate production control factor involved when injecting RAP into existing drum mixer or batch plants is the maximum temperature limitation of the virgin aggregate. As higher RAP percentages are used, the aggregate temperature must increase accordingly to heat the RAP. Therefore, there is an inherent and built in limitation on the percentage of RAP that can be injected into current asphalt plants simply due to the mechanical design the rotary dryers and the metallurgy used in most of the plants in the field today.

The present invention is a heating device that consists of a large hollow, jacketed heated auger or augers that gradually and slowly elevate RAP and/or aggregate to a temperature sufficient to permit drying and heating of a final mix to whatever temperature is desired to achieve plant productive capacity. The present invention used to pre-dry and pre-heat both aggregate and RAP allows the use of higher RAP percentages since aggregate does not have to be super heated allowing dryer shell temperatures to operate at normal levels. Dryer burner firing rates are also reduced and exhaust systems are generally returned to normal operating capacities, for example, at approximately 65%. Aggregates do not fracture at minus 500° F. and RAP moisture does not enter the dryer system. Asphalt "stripping" is greatly reduced since the internal moisture in the RAP has been removed prior to dryer entry. The heating auger system is a sealed, emissions free, conductive heating device with fully automatic operation that is installed at the plant in either a stationary or mobile configuration to dry and conductively pre-heat heat RAP prior to dryer entry.

The present invention does not require a typical asphalt plant air emissions permit as normally required for an asphalt plant or asphalt plant up-grade package. The contractor should not have to seek a permit application that requires public notice or forum. The present invention reduces exhaust system capacity by lowering burner firing rates. Particulate emissions are also reduced due to more rapid capture of dust within the dryer on pre-liquefied surfaces of the heated RAP. Fugitive emissions are eliminated on a batch plant operation when injecting RAP by removing moisture prior to injection. The unit of the present invention does require a hot oil heater/heat exchanger permit, however, the combustion system is designed to meet and exceed all $NO_x$, $SO_x$, CO, and particulate emissions levels.

There are a number of different sizes and configurations, mobile and stationary, depending upon type of plant and field layout requirements. The system of the present invention may also be installed in such a manner as to be easily converted to a 100% RAP recycling system that uses two augers and two heat exchangers, or other similar devices.

The milled recycled pavement and/or aggregate are fed into the invention by means of a conveyor. The heating chamber indirectly heats the RAP to approximately 200° F. This heating occurs while the material is passing through a heated jacketed hollow screw auger, and moisture is driven out of the material. After exiting the auger drying and heating unit, the RAP is conveyed into the conventional drum mix or batch type asphalt hot mix plant for final mixing with heated virgin aggregates. This drying and pre-heating of the RAP and aggregate permits reduction of virgin aggregate temperature requirements, removes moisture from the inside of the rotary dryer, and better prepares RAP for final heat transfer and mixing.

These and further and other objects and features of the invention are apparent in the disclosure, which includes the above and ongoing written specification, with the drawings.

DETAILED DESCRIPTION OF THE PREFERRED EMBODIMENTS

The invention described herein is a milled asphalt processing unit providing a thermal plant designed for the thermal processing of recycled asphalt pavement, which processes pre-sized recycled asphalt pavement materials having approximately 3% to 8% moisture content.

Figure 1:
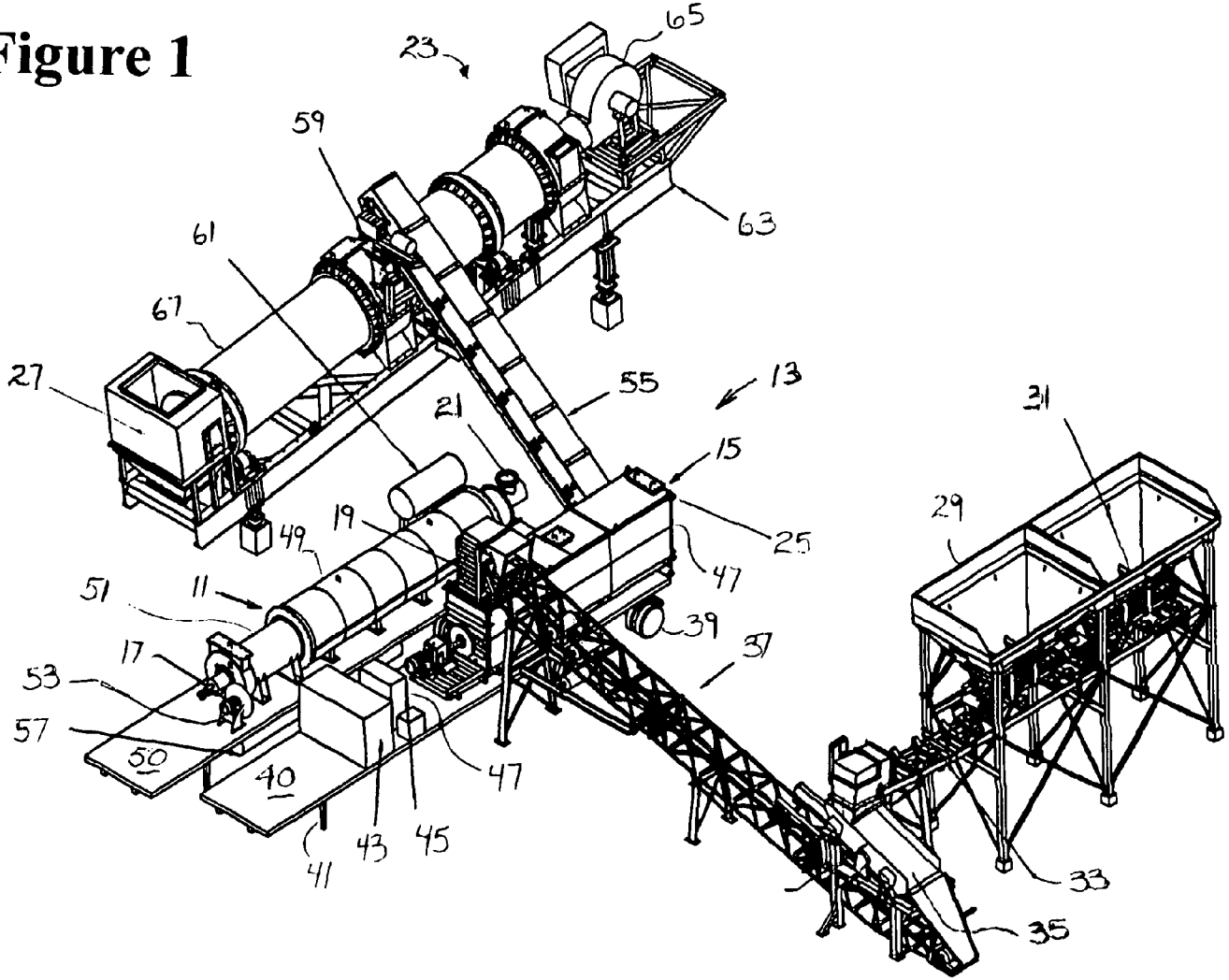
FIG. 1 shows a mobile installation in isometric view of the present system.

In FIG. 1, a gas combustion system 11 is used to gradually heat indirect heat exchange fluid circulating in heat exchanger coils and throughout a millings heating system 13 in the gas combustion system 11. The heated fluid, for example hot oil, circulating in coils within the combustion system 11 flows in the preheater and drier unit 15 to preheat and dry the recycled asphalt pavement (RAP). The gas combustion system 11 also provides heated gas to a jacketed screw conveyor trough in the heater and drier unit 15.

The gas combustion system 11 includes unique types of non-oxidizing or other types of burners 17, utilizing #2 fuel oil, propane, natural gas or other fuels.

RAP millings are gradually fed through a chute 19 and down into the heating and drying unit 15, which contains a jacketed screw conveyor turning within a heated trough. In the heating and drying unit 15 the millings from chute 19 are subjected to heat transfer from hot air pumped through an inlet 21 to the gas combustion system 11 and out to the drying unit 15, as well as from conductive heat transfer from oil-heated jackets and from hot oil flowing through a hollow auger as the millings are moved by the jacketed screw conveyor in the heating and drying unit 15. When the millings exit the heating and dryer 15, they are dry and have achieved an overall temperature of about 175 to 200° F. The pre-dried and pre-heated materials then move into a hot mix asphalt plant 23 for final mixing or into an optional second heating unit for further heating.

A second heating unit containing a second jacketed heated screw conveyor can be used to further elevate RAP temperature to approximately 300° F. if desired.

The gasses from the heating and drying unit 15 and heating unit 11 exit through an exhaust pipe 25 into hot mix asphalt plant exhaust system 27. The gasses are free of particulate or hydrocarbon emissions.

An overall system operates with the present invention combined with existing hot mix asphalt plant 23. RAP is initially loaded into bins 29 with feeders 31. A collecting conveyor 33 carries the RAP past an optional screen 35 and onto a belt conveyor 37. The RAP millings then pass down the chute 19 and into the heater and drier unit 15. The heater and drier unit 15 contains a jacketed screw conveyor 47 with a heated screw and a trough to heat and move the RAP from one end of the heater and drier unit 15 to the opposite end. In a mobile configuration, the heater and drier unit 15 is mounted on a trailer bed with rear wheels 39, supports 41, a generator 43, overall control unit 45, and PLC's 47.

The heating unit 11 may also be mounted on a trailer bed with rear wheels and supports for mobility. The oil and air heating unit 11 includes a heat exchanger 49, combustion chamber 51, a burner 17, a blower 53, a surge tank 61, an exhaust gas outlet 21, and a fuel tank 57.

Once the RAP is heated and dried in the heater and drier unit 15, it is loaded onto a drag slat conveyor 55 for transporting to an existing hot mix asphalt plant 23. A chute 59 transfers the RAP into the existing hot mix asphalt plant 23, which includes a drier 63, blower 65 and process chamber 67.

Figure 2:
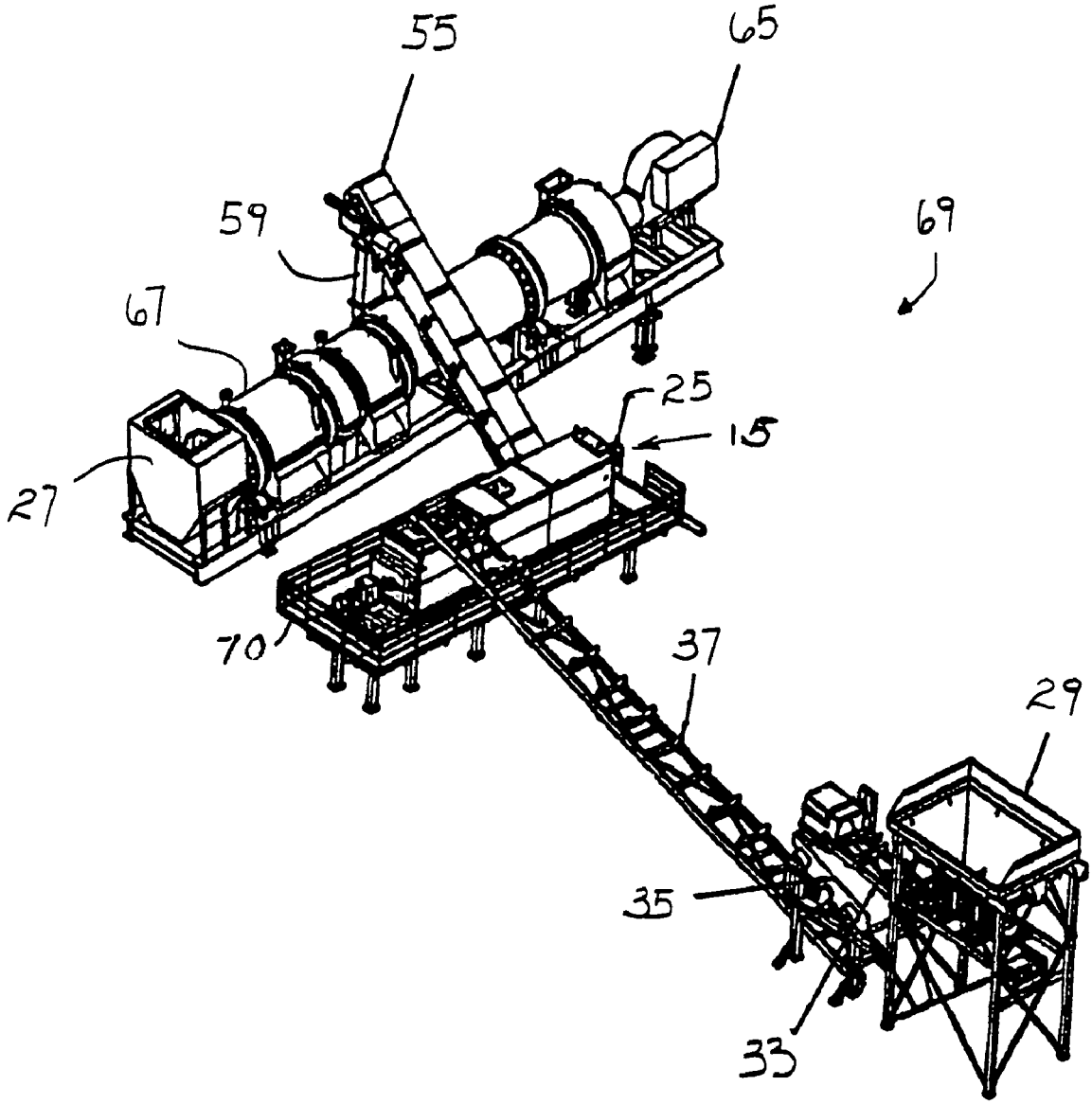
FIG. 2 shows a stationary installation in isometric view of the present system.

FIG. 2 shows a non-mobile installation 69 of the present invention, in which the RAP heater and drier 15 is mounted on a fixed platform 70.

Figure 3:
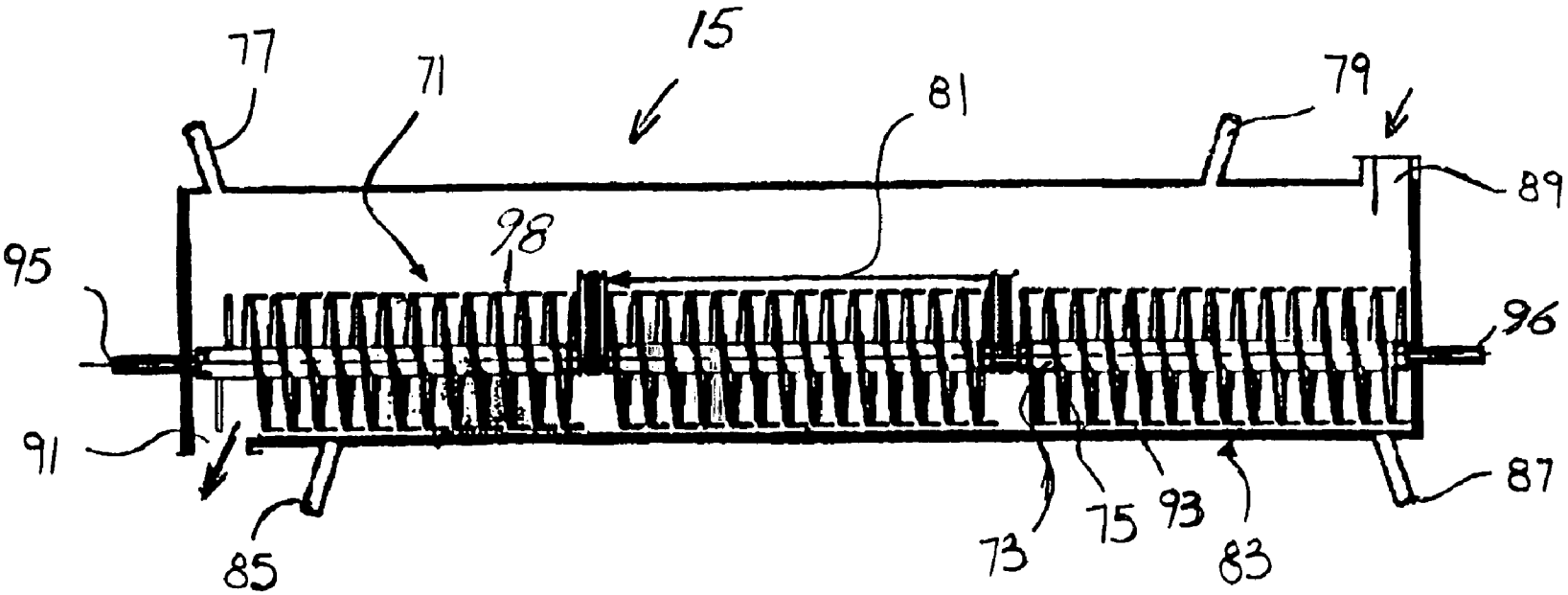
FIG. 3 shows a side elevation of the jacketed screw conveyor used in the dryer and heater.

In a preferred embodiment, the heating and drying unit 15 is a hot oil heated hollow screw auger 71 as shown in FIG. 3. It has a heated shaft 73 and heated blades 75. The heated hollow screw auger 71 results in a larger heat transfer surface area than would a pug mill type of mixer/heater unit with paddles and arms. The hollow auger 71 has better conductive heat transfer and increased heated and dried RAP output. The hot oil flow pattern in the auger 71 and the shaft oil seals in the present invention. The hollow screw auger 71 has a hot air inlet 77 and a hot air outlet 79. The hot air moves in a direction counter to the flow 81 of RAP materials. Hot oil enters a hollow auger through a hollow jacket 83 through a hot oil inlet 85 and exits through a hot oil outlet 87. The hot oil in the jacket and auger trough also moves in a direction opposite the flow of RAP materials along the hollow screw auger 71. The milled asphalt RAP enters the heater and drier unit 15 through an inlet 89 and exits through an outlet 91. An insulation jacket 93, for reducing heat transfer to the surroundings, surrounds the auger 71. A hot oil inlet 95 in one end of the auger shaft 73 admits hot oil, which flows out the opposite end of the shaft through hot oil outlet 96.

The heat transfer fluid, at temperatures from approximately 400° F. to 650° F., is pumped through the outer jacket 83 and the hollow screw auger 71 at pressures of about 40 to 85 psi. The heat exchanger fluid is pumped at the optimum velocity for conductive heat exchange, approximately 7.0 feet per second.

Horizontal bars 98 on the auger 71 stir the mixture of materials and have a pug mill effect.

Hot gasses, at about 500° to 850° F., contact the exposed surface area of the RAP and "flash off" the moisture from the RAP aggregate as the moisture is driven from the center of the particle (rock) to the surface by conductive heat transfer from the hot jacketed surfaces of the trough sidewalls and hollow auger blades 75.

Figure 4:
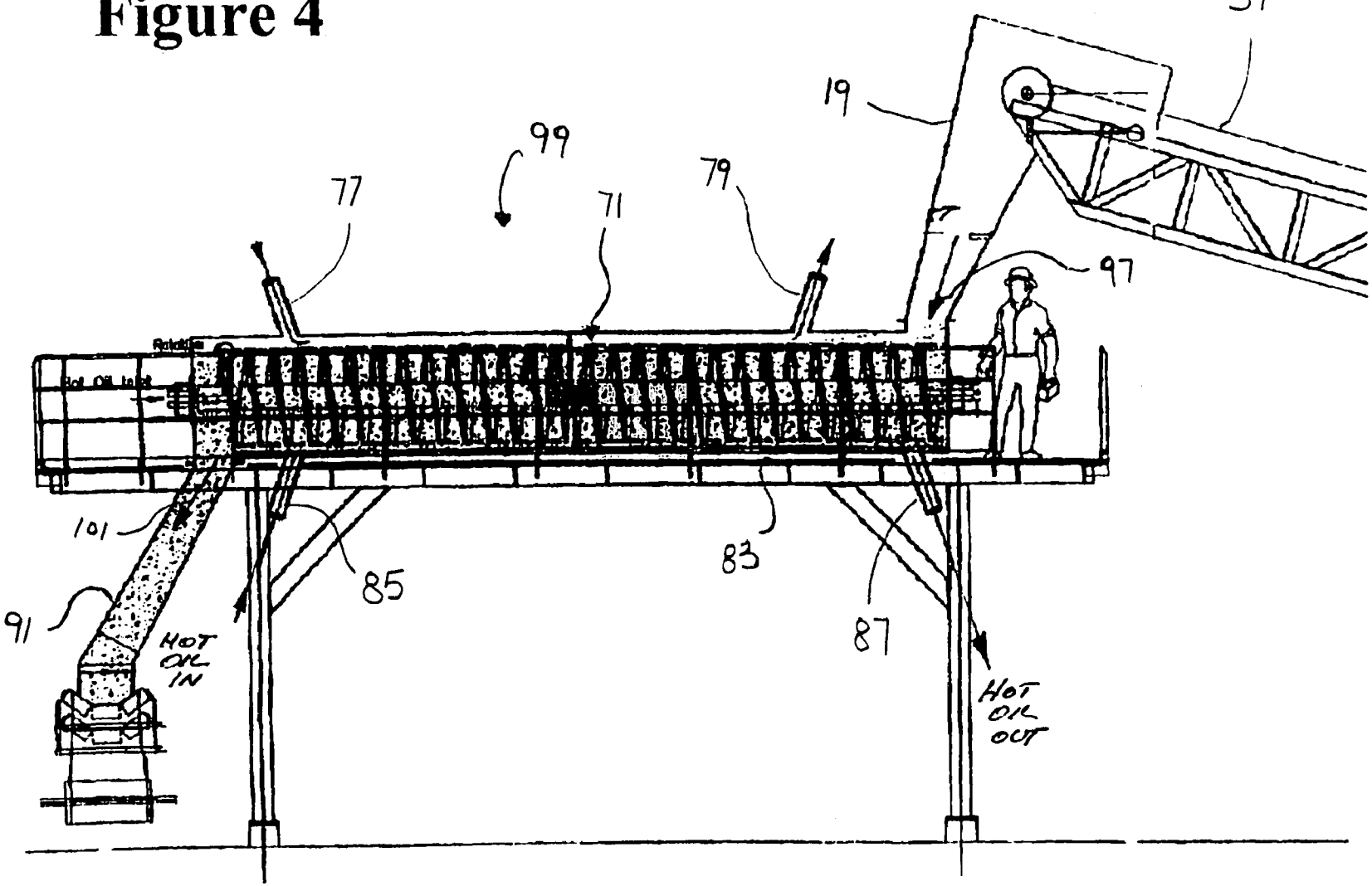
FIG. 4 shows a side elevation of present system in operation at a hot mix plant.

The invention can be placed at a hot mix plant to pre-heat the recycled asphalt pavement before it goes into the plant for processing. In FIG. 4 recycled asphalt pavement 97 is fed into the recycled asphalt pavement (RAP) saver booster unit 99, where it is dried and heated, and then the outflow 101 of heated recycled asphalt pavement through the outlet 91 is fed directly into a hot mix plant 23. Similar numbers in the booster unit 99 describe features similar to those in the heater and drier 15.

Figure 5:
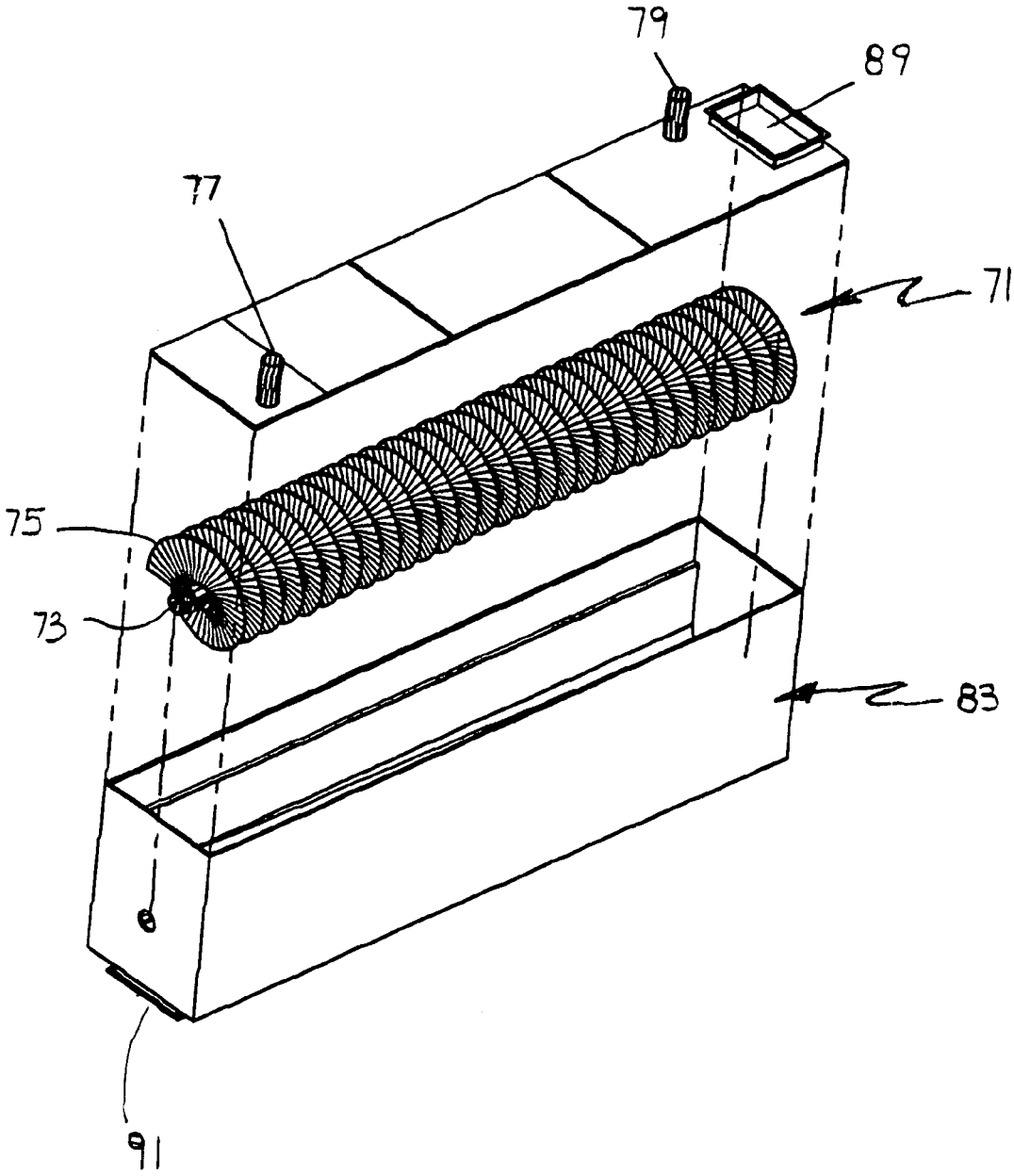
FIG. 5 is an exploded view of jacketed trough and hollow screw conveyor.
Figure 7:
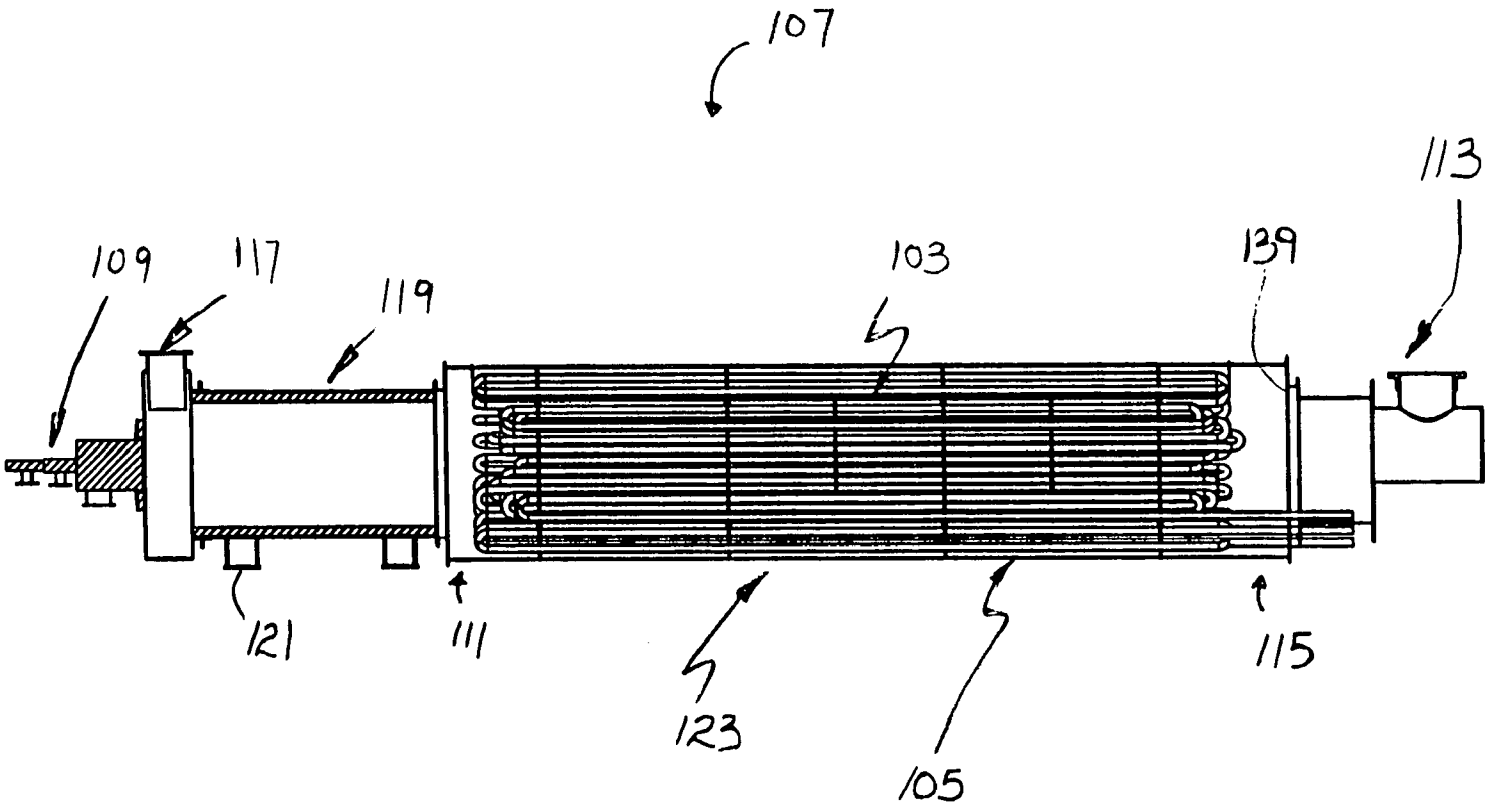
FIG. 7 shows a side elevation cutaway view of heat exchanger.

FIG. 5 shows the details of the indirect heating screw conveyor 71. The system utilizes a heat exchanger fluid as the primary heat transfer medium. The heat exchanger fluid is pumped through a tube type heat exchanger, preferably, but not limited to a heat exchanger having a continuous 2" serpentine pipe coil or through a helically coiled hot oil heater, as shown in FIG. 7. The heat exchanger hot fluid is then pumped through the screw conveyor jackets 83 and hollow auger 71, as shown in FIG. 5. Heated exhaust gasses from the heat exchanger oil heater are also directed through inlet 77 over the head space area above the screw conveyor 71 to flash off moisture. The moisture laden hot gasses exit via hot gas outlet 79 and are either stacked to atmosphere or directed to the plant exhaust ducting for preheating incoming air and materials. The trough 83 is heated with hot oil or hot gasses.

Figure 6:
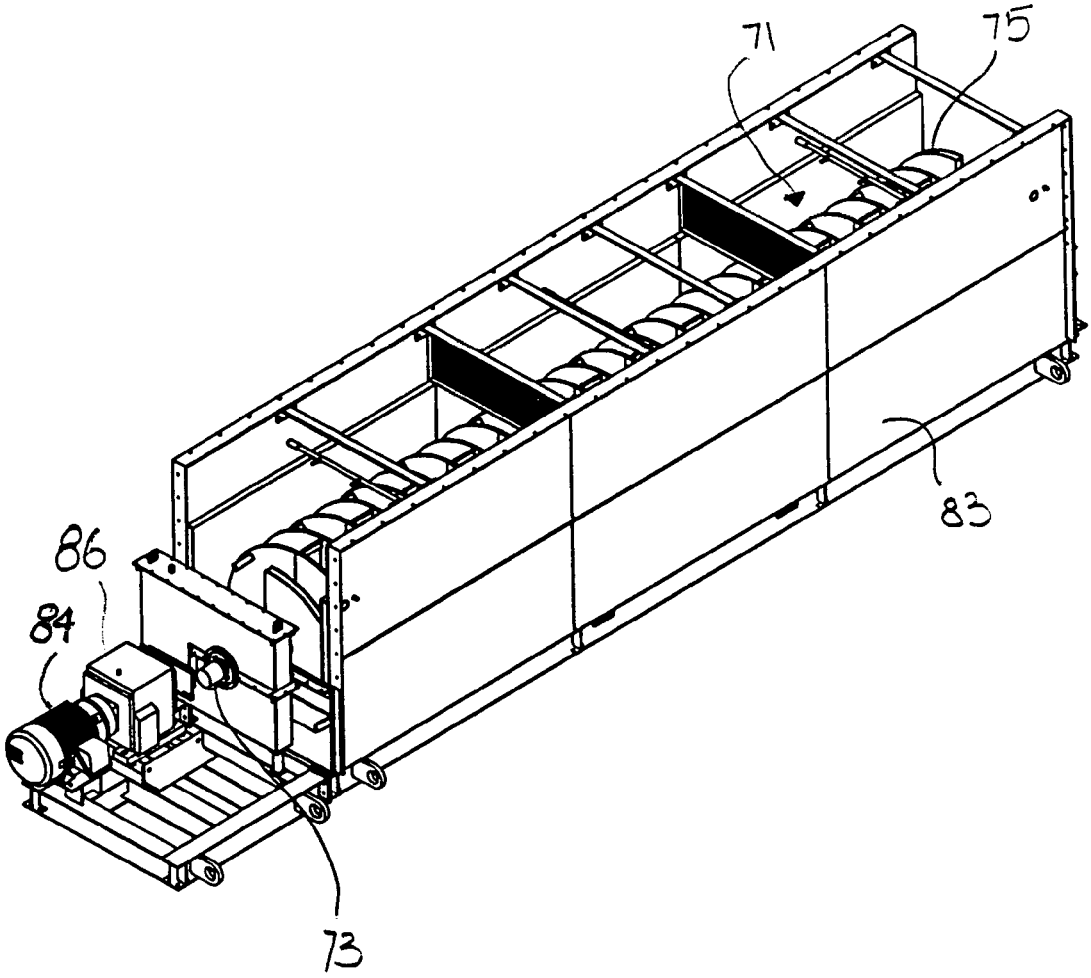
FIG. 6 shows an auger assembly.

FIG. 6 is a partially exploded view that shows an auger 71 of the present invention in a jacket 83. A motor 84 and speed reducer 86 drive the auger.

FIG. 7 shows a profile of the primary oil heating element 103 in a coil section 123. The element 103 is covered with an insulated coil shell 105 that prevents heat from escaping the system 107. The system pressure is steady and has a minimum of about 40 to 60 psi. The recirculated hot oil may be quite warm from previous use, and warm up time may be short. The hot fluid is brought to a temperature of approximately 400° F. to 650° F. Jacketed surfaces of the heater and drier unit 15 heat very quickly and within about 15 to 30 minutes from starting the unit 15 is ready to accept recycled asphalt pavement feed. The burner 109 located at one end 111 of the exchanger heats the entire system. Hot gasses exhaust through exit 113 on an opposite end 115 and flow into the jacketed screw auger's trough as overlay sweep gas for preheating and drying the RAP and flashing moisture from the RAP. When using a second heat exchanger and second screw conveyor, hot gasses that exit the auger troughs may be recirculated through one of the two heat exchangers at inlet 117 which allows hot gasses to enter and preheat a combustion chamber 119 and be oxidized for thermal oxidation before exiting the system through exits 121.

Figure 8:
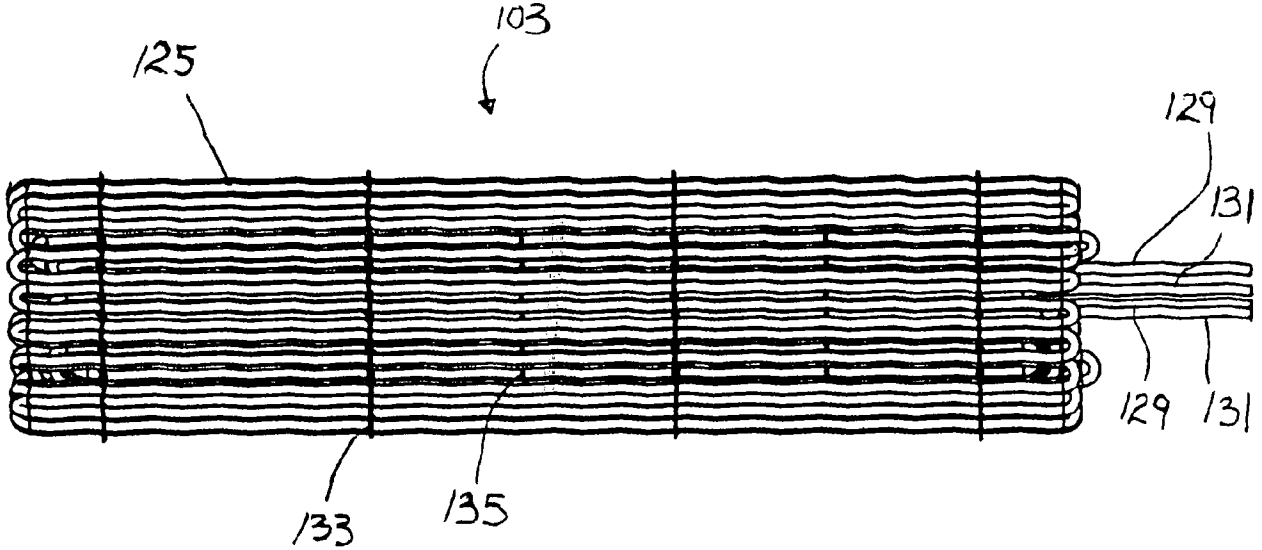
FIG. 8 shows a side view of a heat exchanger dual coil.
Figure 9:
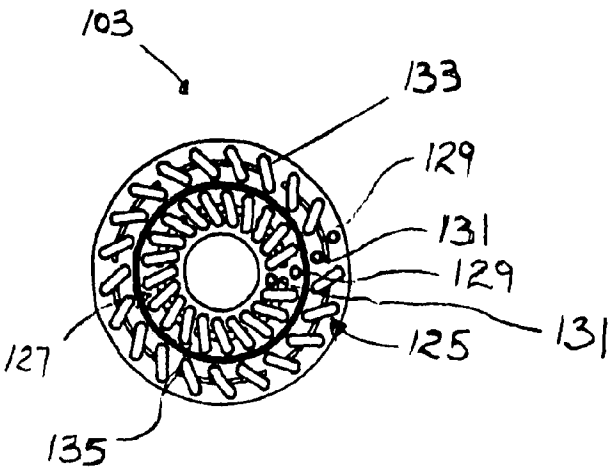
FIG. 9 shows an end view of heat exchanger dual coil.

FIGS. 8 and 9 show the heat exchanger dual serpentine coil 103 of FIG. 7 with the insulated outer shell 105 removed. Long tubing 125 runs down the interior of the exchanger 103, surrounding an inner coil 127. Heat exchange fluid can enter and exit the system through tubes 129 and 131 respectively.

Figure 10:
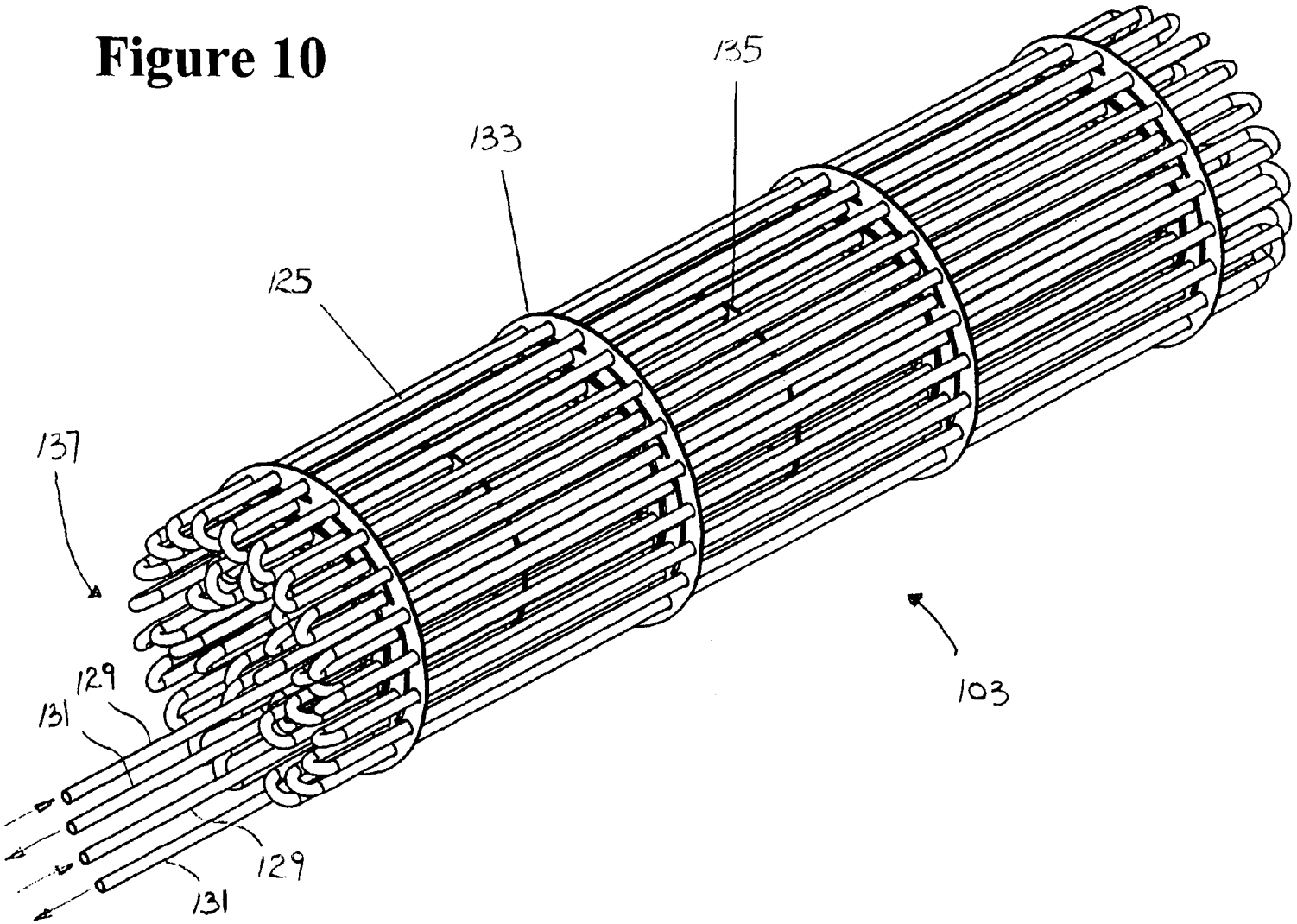
FIG. 10 shows an isometric view of heat exchanger dual coil.

FIG. 10 shows an isometric view of the heat exchanger coil 103. The continuous reentrant outer tube 125 is held in place by ribbed rings 133, and rings 135 secure the inner tubing coil 127. The exit end 137 of the exchanger has an endplate 139 with tube exit holes.

Figure 11:
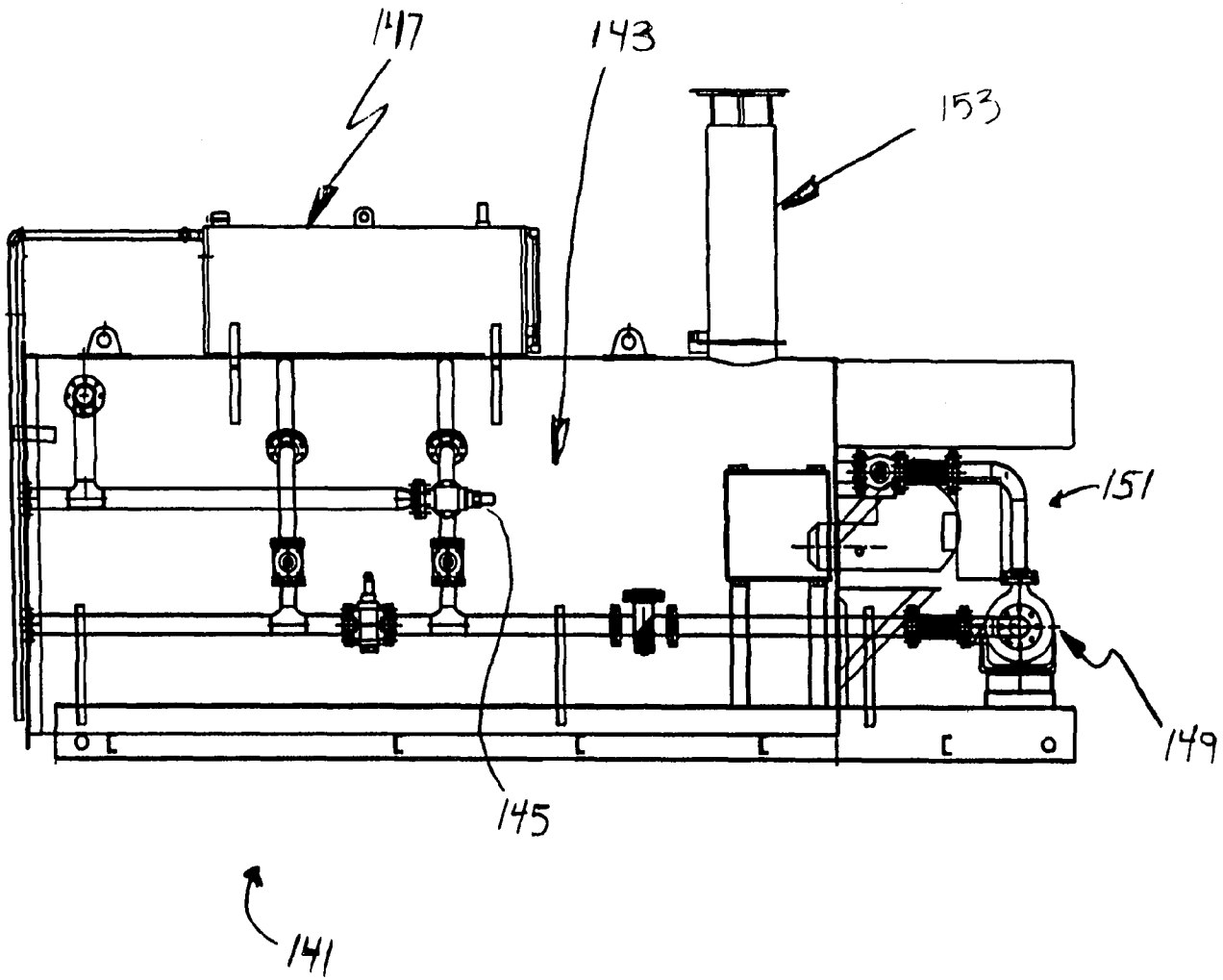
FIG. 11 shows a side view of a typical hot oil heater system.
Figure 12:
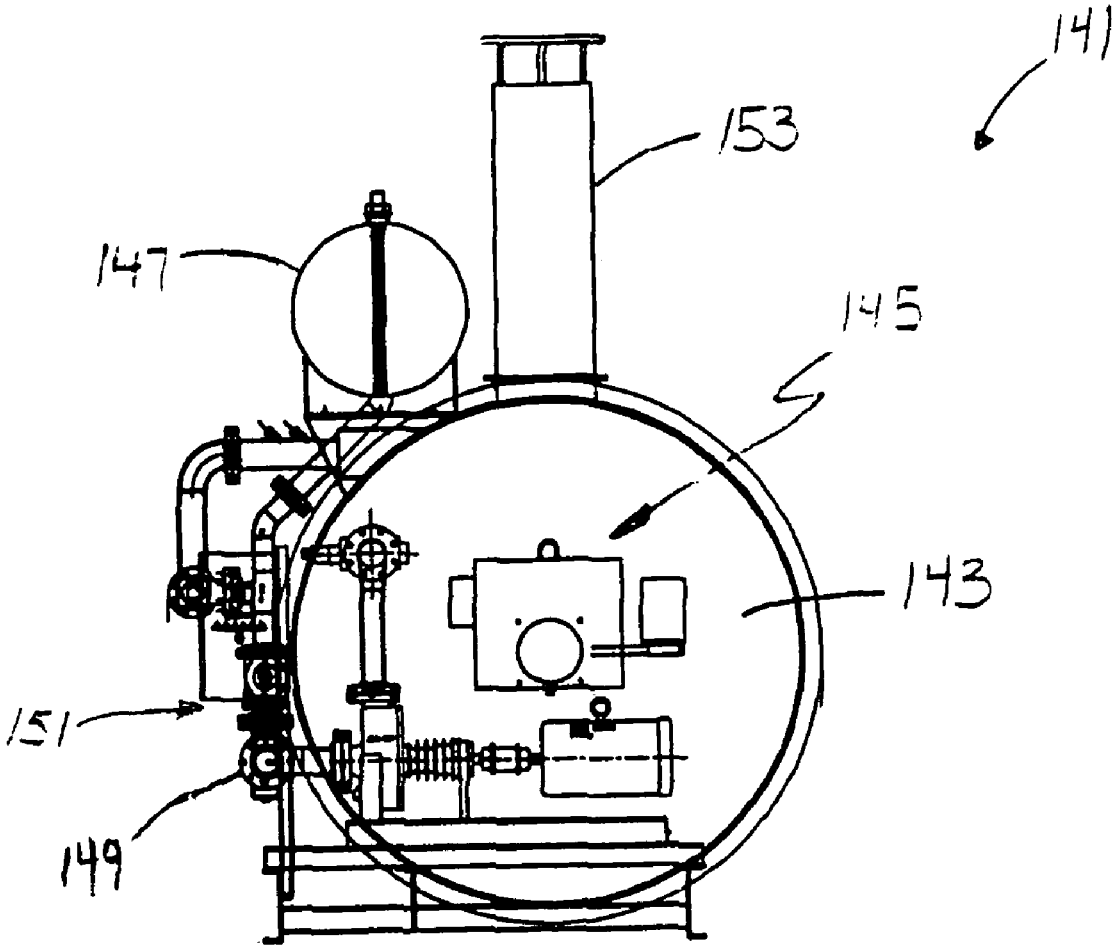
FIG. 12 shows an end view of a typical hot oil heater system.

FIGS. 11 and 12 show a side and end view of a typical hot oil heater 141 which may be used in place of the heat exchanger system 11. A helical heating coil section 143 is located near a burner 145. A surge tank 147 is located above the heating coil section 143. A circulating pump 149 and circulation system 151 move air through the system 141, and air is exhausted through an exhaust stack 153.

Figures 13, 14:
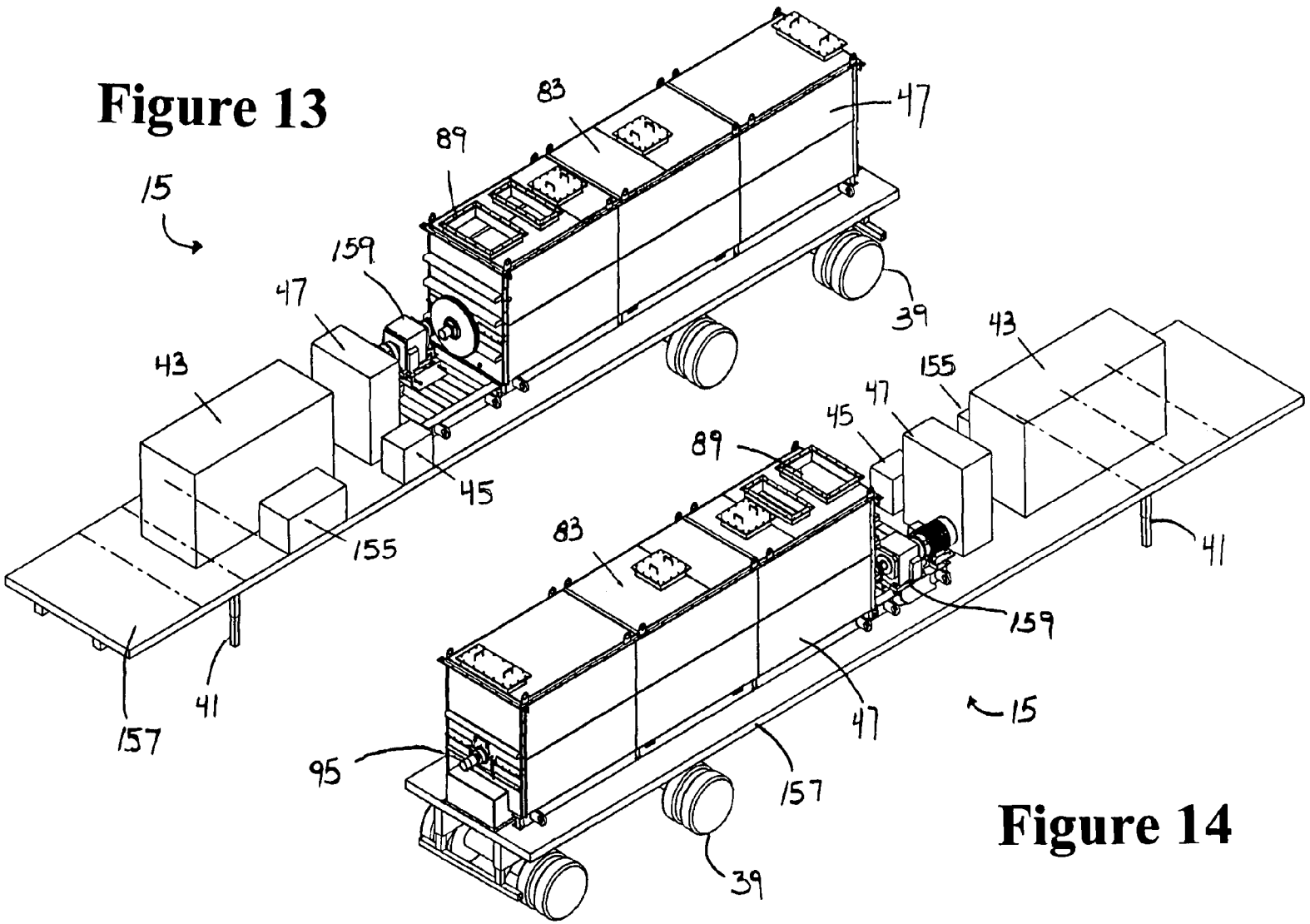
FIG. 13 shows an isometric view of the trailer mounted screw conveyor.
FIG. 14 shows an opposite isometric view of the trailer mounted screw conveyor.

FIGS. 13 and 14 are isometric views of a mobile or trailer mounted auger 15 on a bed 157 showing some of the components that can be applied to the system as options: generator 43, diesel tank 155, and PLC's 47, and operating controls 45.

Figures 15, 16:
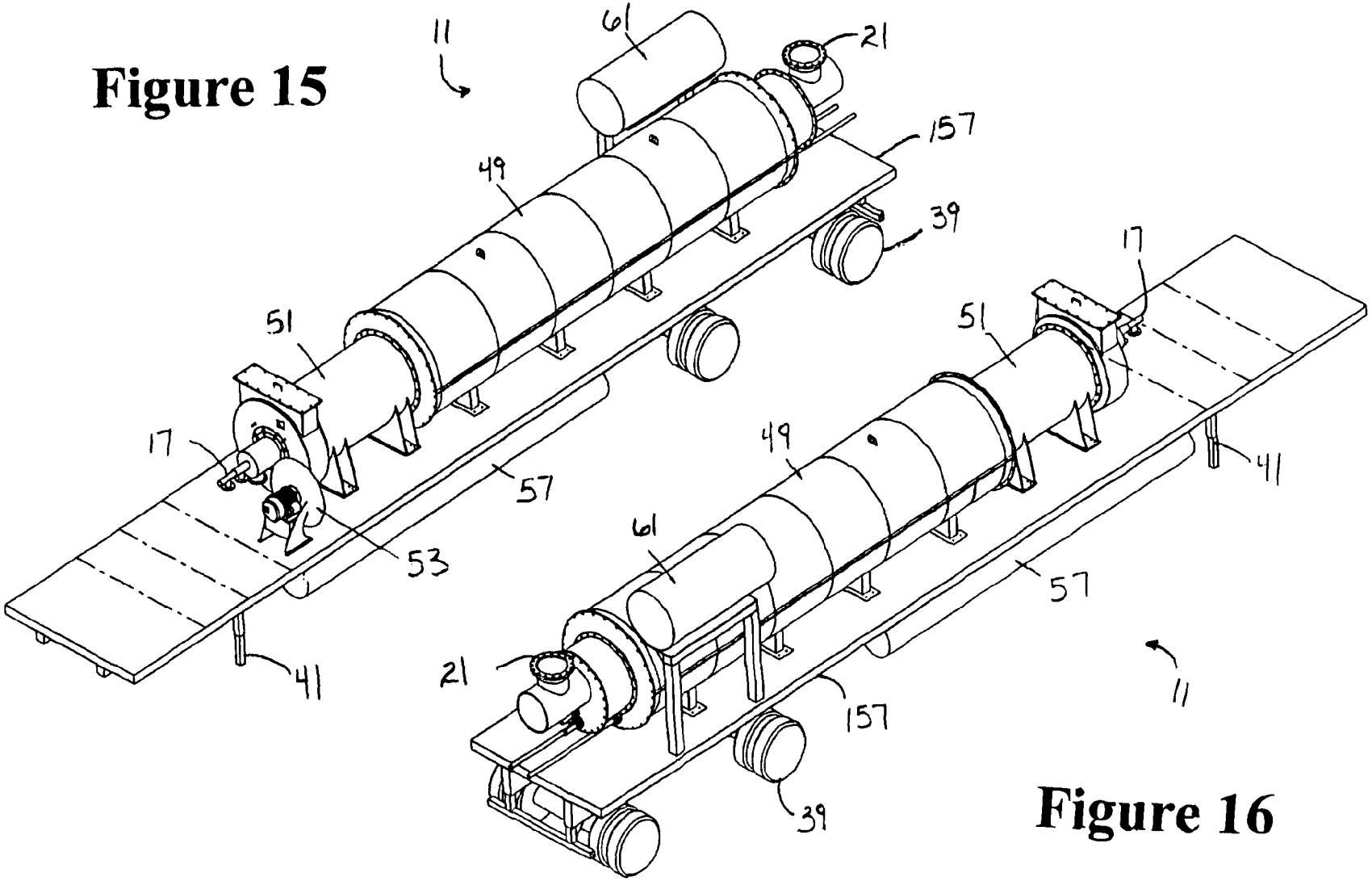
FIG. 15 shows an isometric view of the trailer mounted heat exchanger.
FIG. 16 shows an opposite isometric view of the trailer mounted heat exchanger.

FIGS. 15 and 16 are isometric views of the mobile heat exchanger system 11 showing combustion chamber 51, surge tank 61, motor 159 and burner unit 17.

While the invention has been described with reference to specific embodiments, modifications and variations of the invention may be constructed without departing from the scope of the invention.

The invention claimed is:

1. A recycled asphalt pavement preparation method using a recycled asphalt pavement preparation system comprising:

providing milled asphalt for recycling, providing a heater and drier unit, providing a heat exchange unit, providing a hollow screw auger within the heater and drier unit, heating heat exchange fluid and hot gas in a burner unit, insulating the heater and drier unit with an insulation jacket, feeding recycled asphalt pavement into an inlet on the heater and drier unit, moving the recycled asphalt pavement through the heater and drier unit with the hollow screw auger, heating the recycled asphalt pavement by conducting heat from the heat exchange fluid moving through the hollow screw auger, heating the recycled asphalt pavement by contacting the recycled asphalt pavement with the hot gas moving through the heater and drier unit, recirculating the heat exchange fluid and the hot gas back to the burner unit, and removing the heated recycled asphalt pavement from the heater and drier unit through an outlet.

2. The method of claim 1, further comprising mounting the recycled asphalt pavement preparation system on one or more over-the-road trailer beds and moving the recycled asphalt pavement preparation system to an asphalt plant.

3. The method of claim 1, wherein the providing the heat exchange unit further comprises providing a burner in the burner unit, a combustion chamber, and a heat exchanger connected to the combustion chamber.

4. The method of claim 1, wherein the heat exchange fluid comprises hot oil and wherein the heat exchange unit comprises a hot oil heater.

5. The method of claim 1, further comprising flowing the heat exchange fluid and the hot exhaust gas in a direction opposite of the moving of the milled recycled asphalt pavement through the heater and drier unit.

6. The method of claim 1, further comprising providing a second heater and drier unit connected in series with the first heater and drier unit for further elevating temperature of the heated and dried milled recycled asphalt pavement.

7. The method of claim 1, further comprising connecting the recycled asphalt pavement preparation system to an existing hot mix asphalt plant, loading the heated and dried milled recycled asphalt pavement, and mixing the heated and dried milled recycled asphalt pavement with aggregate and tar in the hot mix asphalt plant.

8. The method of claim 7, wherein the heater and drier unit further comprises an inlet chute supplying the milled recycled asphalt pavement to the inlet of the heater and drier unit and an exit conveyor connected to the heated and dried milled recycled asphalt pavement outlet on the heater and drier unit.

* * * * *